US005180104A

United States Patent [19]

Mellette

[11] Patent Number: 5,180,104

[45] Date of Patent: Jan. 19, 1993

[54] HYDRAULICALLY ASSISTED HIGH VOLUME LOW PRESSURE AIR SPRAY GUN

[75] Inventor: Robert R. Mellette, Nederland, Colo.

[73] Assignee: Binks Manufacturing Company, Franklin Park, Ill.

[21] Appl. No.: 658,080

[22] Filed: Feb. 20, 1991

[51] Int. Cl.[5] ..... B05B 1/26; B05B 1/28

[52] U.S. Cl. ..... 239/8; 239/11; 239/296; 239/300; 239/599

[58] Field of Search ..... 239/8, 11, 290, 296, 239/297, 300, 599

[56] References Cited

U.S. PATENT DOCUMENTS

| | | | |
|---|---|---|---|
| 1,982,055 | 11/1934 | Jenkins | 239/301 |
| 2,082,061 | 6/1937 | Jenkins | 239/300 |
| 4,232,824 | 11/1980 | Binoche | 239/8 |
| 4,537,357 | 8/1985 | Culbertson et al. | 239/290 |
| 4,713,257 | 12/1987 | Luttermöller | 239/296 X |
| 4,759,502 | 7/1988 | Pomponi, Jr. et al. | 239/300 X |
| 4,824,017 | 4/1989 | Mansfield | 239/296 X |
| 4,915,303 | 4/1990 | Hufgard | 239/290 X |
| 4,991,776 | 2/1991 | Smith | 239/290 X |
| 4,993,642 | 2/1991 | Hufgard | 239/300 |
| 5,044,557 | 9/1991 | Smith | 239/290 X |

FOREIGN PATENT DOCUMENTS 3417229 11/1985 Fed. Rep. of Germany ..... 239/296

*Primary Examiner*—Andres Kashnikow
*Assistant Examiner*—William Grant
*Attorney, Agent, or Firm*—Juettner Pyle & Lloyd

[57] ABSTRACT

A hydraulically assisted high volume low pressure air spray gun has an airless tip for hydraulically emitting a fan-shaped pattern of liquid coating material, an atomizing air orifice for emitting air to pneumatically break up the pattern of coating material into a fan-shaped atomized spray and opposed side port air orifices for emitting jets of air that impinge against opposite sides of the spray. The gun received coating material at pressures in the range of about 25 to 1000 psi and air at pressures up to about 60 psi. An air flow restrictor limits the pressure of air at a spray head of the gun and a valve for controlling the flow rate of air to the side port orifices also simultaneously controls the flow rate of air to the spray head to limit the pressure of air at the spray head to no more than a selected maximum pressure, despite changes in the flow rate of air to the side port orifices. By virtue of the coating liquid being hydraulically emitted from the airless tip in a fan-shaped pattern, less pneumatic energy is required to fully atomize the coating and improved atomization is obtained for a given pressure and volume flow rate of air at the spray head.

17 Claims, 2 Drawing Sheets

HYDRAULICALLY ASSISTED HIGH VOLUME LOW PRESSURE AIR SPRAY GUN

BACKGROUND OF THE INVENTION

The present invention relates to high volume low pressure air spray guns, and in particular to a hydraulically assisted air spray gun in which high volume low pressure air pneumatically atomizes liquid coating material that is hydraulically emitted in a fan-shaped pattern from an airless tip.

To decrease the cost of coating material used in spray coating processes and for environmental considerations, there has been a trend toward spray coating equipment having a high transfer efficiency. Transfer efficiency is the amount of coating solids applied onto a target versus the amount of coating solids sprayed, expressed as a percentage. To increase transfer efficiency, the velocity of the coating particles should advantageously be fairly slow in order to avoid blow-by which occurs when spray particles miss the target, with excessive velocity of the particles actually causing some of the particles that strike the target to bounce off of it. Greatest transfer efficiency is usually achieved in systems offering optimum atomization coupled with the lowest possible velocity of the particles.

Conventional air spray guns have a relatively low transfer efficiency. Air delivered to their spray heads has relatively high pressure on the order of 25 psi or more and as it exits the spray head it atomizes a cylindrical stream of liquid coating material into a conically-shaped spray, which usually is flattened into a fan-shaped pattern by opposed side port air jets. When the high pressure air exits the spray head, it expands and imparts a relatively high velocity and fogging effect to the spray particles, causing a large percentage of the particles to miss the target.

Airless spray systems have a somewhat higher transfer efficiency. With such systems, coating liquid is hydraulically forced through a specially shaped orifice at pressures on the order of 500–4500 psi, which causes the coating to be emitted in an unstable thin film that breaks up into an atomized spray at its forward edge. These systems develop spray particles that have a lower velocity and exhibit less fogging than occurs with conventional air spray guns.

A more recent development is the air-assisted airless system, which utilizes both airless and air atomization. Coating liquid is supplied to a specially shaped orifice at hydraulic pressures less than those normally encountered in purely airless systems, usually on the order of 300–1000 psi. This causes the material to be atomized into a spray, but the degree of atomization is not as satisfactory as is obtained with conventional airless or air spray guns. To improve atomization, an air assist is applied to the spray pattern, enhancing the atomization process and doing away with tails that would otherwise mar the finish. The transfer efficiency of air-assisted airless systems is greater than those of conventional airless or air spray systems.

Recently, high volume low pressure (HVLP) air spray systems have found increasing use because of their high transfer efficiency. These systems rely solely upon pneumatic atomization and utilize air to atomize a stream of coating material. At the spray head the air has a relatively high volume flow rate, usually well in excess of 5 CFM, and a relatively low delivery pressure, usually less than 15 psi. The high volume and low pressure of the air results in decreased fogging and an increased percentage of the spray particles striking and adhering to the target.

Some HVLP spray guns use a turbine to supply air at high volume and low pressure to an inlet to the gun, from which it passes through enlarged air passages to the spray head. A significant disadvantage is that a separate turbine is required for supplying air, which increases the cost and complexity of the system. Other HVLP spray guns, such as the one disclosed in U.S. Pat. No. 3,796,376 to Farnsteiner, receive high pressure factory air at their inlet. Such guns have a venturi in their handle air passage downstream from the inlet, to reduce the pressure and increase the volume flow of air into the gun body. To further increase the volume flow of air into the gun, in the spray gun of U.S. Pat. No. 3,796,376, passages in the handle admit atmospheric air by the action of the compressed air passing through the venturi. From the venturi, air then passes at a reduced pressure and increased volume through passages in the gun body to the spray head. Another HVLP spray gun is disclosed in U.S. Pat. No. 4,761,299 to Hufstetler.

It is desirable with HVLP spray guns to be able to control the shape of the spray pattern. Conventionally, this requires that the cylindrical stream of coating material that is broken up into a conically diverging atomized spray be selectively shaped between conical and flat fan by directing jets of side port air against opposite sides of the spray. However, with many such guns no provision is made to control the pressure of air at the spray head as the flow of side port air is varied. In consequence, an undesirable increase in spray head air pressure can occur when the side port air flow rate is reduced.

Although some prior HVLP spray guns, such as the one of said U.S. Pat. No. 4,761,299, develop at the spray head a relatively low pressure of air on the order of 15 psi or less, it has become desirable to limit the maximum pressure of air at the spray head to 10 psi or less. This is because HVLP spray guns that are limited to an air pressure of 10 psi or less at the spray head inherently have a high transfer efficiency. As a result, certain environmental protection agencies, such as those in California, which otherwise would require as a condition for use of a spray gun that it be tested to meet at least a specified minimum transfer efficiency, automatically exempt a gun from testing if the pressure of air at its spray head is 10 psi or less.

OBJECTS OF THE INVENTION

An object of the invention is to provide a hydraulically assisted HVLP air spray gun which utilizes at its spray head air having a relatively low pressure and high volume to pneumatically atomize a fan-shaped pattern of liquid coating material that is hydraulically emitted from an airless tip.

A further object is to provide such a spray gun that is adapted to be supplied with air at a relatively high pressure, yet limits the pressure of air at its spray head to no more than a selected lower pressure.

Another object is to provide such a spray gun in which spray head air pressure is limited to no more than the selected pressure despite a reduction in the volume flow rate of air to side port orifices of the gun.

SUMMARY OF THE INVENTION

In accordance with the present invention, a method of spraying liquid coating material comprises the steps of delivering liquid coating material to a spray head and emitting the coating material delivered to the spray head from an elongate fluid orifice in the spray head in a flat fan-shaped pattern. Also included are the steps of supplying air to the spray head at a flow rate in excess of 5 CFM at the spray head and at a pressure of less than 15 psi at the spray head, and emitting the air supplied to the spray head from an atomizing air orifice in the spray head to break up the flat fan-shaped pattern of coating material into a flat fan-shaped atomized spray.

In a preferred practice of the method, the supplying step supplies air to the spray head at a pressure of 10 psi or less at the spray head. The elongate orifice is in an airless tip and the delivering step delivers coating material to the spray head at a pressure less than sufficient to fully hydraulically atomize the coating material upon its emission from the elongate orifice in the flat fan-shaped pattern. The air emitting step comprises emitting air from an atomizing air orifice that encircles the elongate fluid orifice, and also included is the step of emitting air delivered to the spray head from opposed side port air orifices to impinge jets of air against opposite sides of the spray.

In addition to the foregoing, also included are the steps of adjusting the volume flow rate of air emitted from the side port air orifices and, in response to and concurrently with performance of the adjusting step, adjustably controlling the volume flow rate of air supplied to the spray head to prevent the pressure of air at the spray head from exceeding a selected maximum pressure as a result of changes in the volume flow rate of air emitted from the side port air orifices.

The invention also contemplates a hydraulically assisted high volume low pressure air spray coating apparatus, which comprises a spray head having an elongate fluid orifice and an atomizing air orifice, and means for delivering liquid coating material to the spray head for emission from the elongate fluid orifice in a flat fan-shaped pattern. The apparatus also includes means for supplying air to the spray head at a flow rate in excess of 5 CFM at the spray head and at a pressure of less than 15 psi at the spray head for emission from the atomizing air orifice to break up the flat fan-shaped pattern of coating material into a flat fan-shaped atomized spray.

Advantageously, the supplying means supplies air to the spray head at a pressure of 10 psi or less at the spray head. The elongate orifice is in an airless tip and the delivering means delivers coating material to the spray head at a pressure less than sufficient to fully hydraulically atomize the coating material upon its emission from the elongate orifice in the flat fan-shaped pattern. The atomizing air orifice encircles the elongate fluid orifice.

In a preferred embodiment of the apparatus, the spray head has opposed side port air orifices and air supplied to the spray head is also emitted from the side port air orifices to impinge jets of air against opposite sides of the spray. In addition, also included are means for adjusting the volume flow rate of air emitted from the side port air orifices and means, responsive to operation of the adjusting means, for concurrently adjustably controlling the volume flow rate of air supplied to the spray head to prevent the pressure of air at the spray head from exceeding a selected maximum pressure as a result of changes in the volume flow rate of air emitted from the side port air orifices.

The foregoing and other objects, advantages and features of the invention will become apparent upon a consideration of the following detailed description, when taken in conjunction with the accompanying drawings.

DETAILED DESCRIPTION

Figure 1:
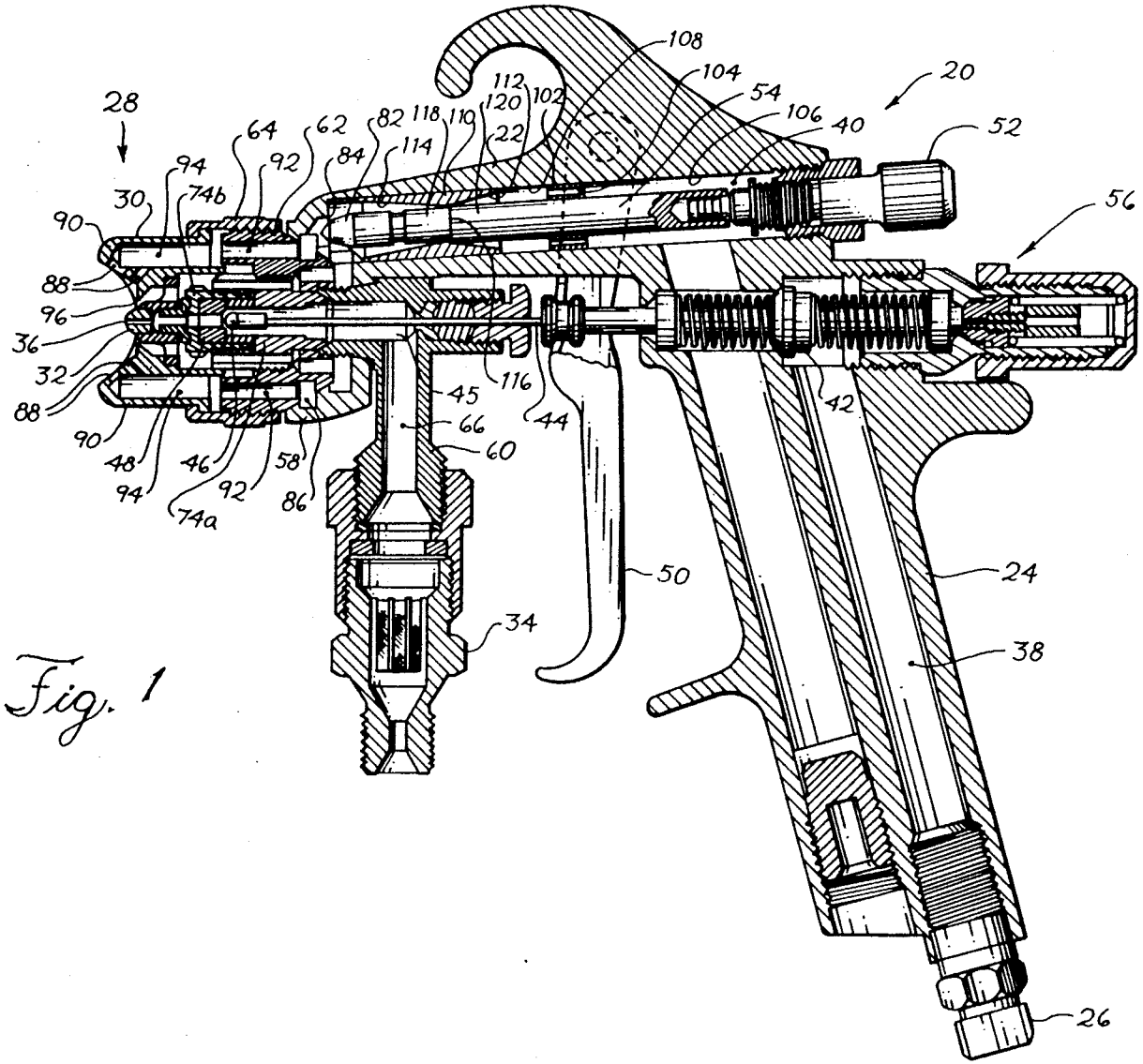
FIG. 1 is a side elevation view, partly in cross section, illustrating a hydraulically assisted HVLP air spray gun constructed in accordance with the teachings of the invention.
Figure 3:
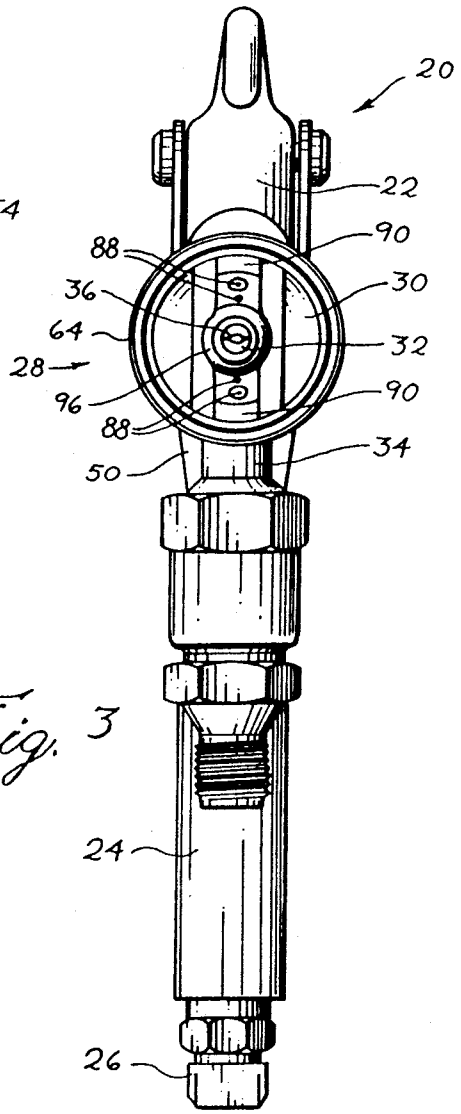
FIG. 3 is a front elevation view of the spray gun.
Figure 2:
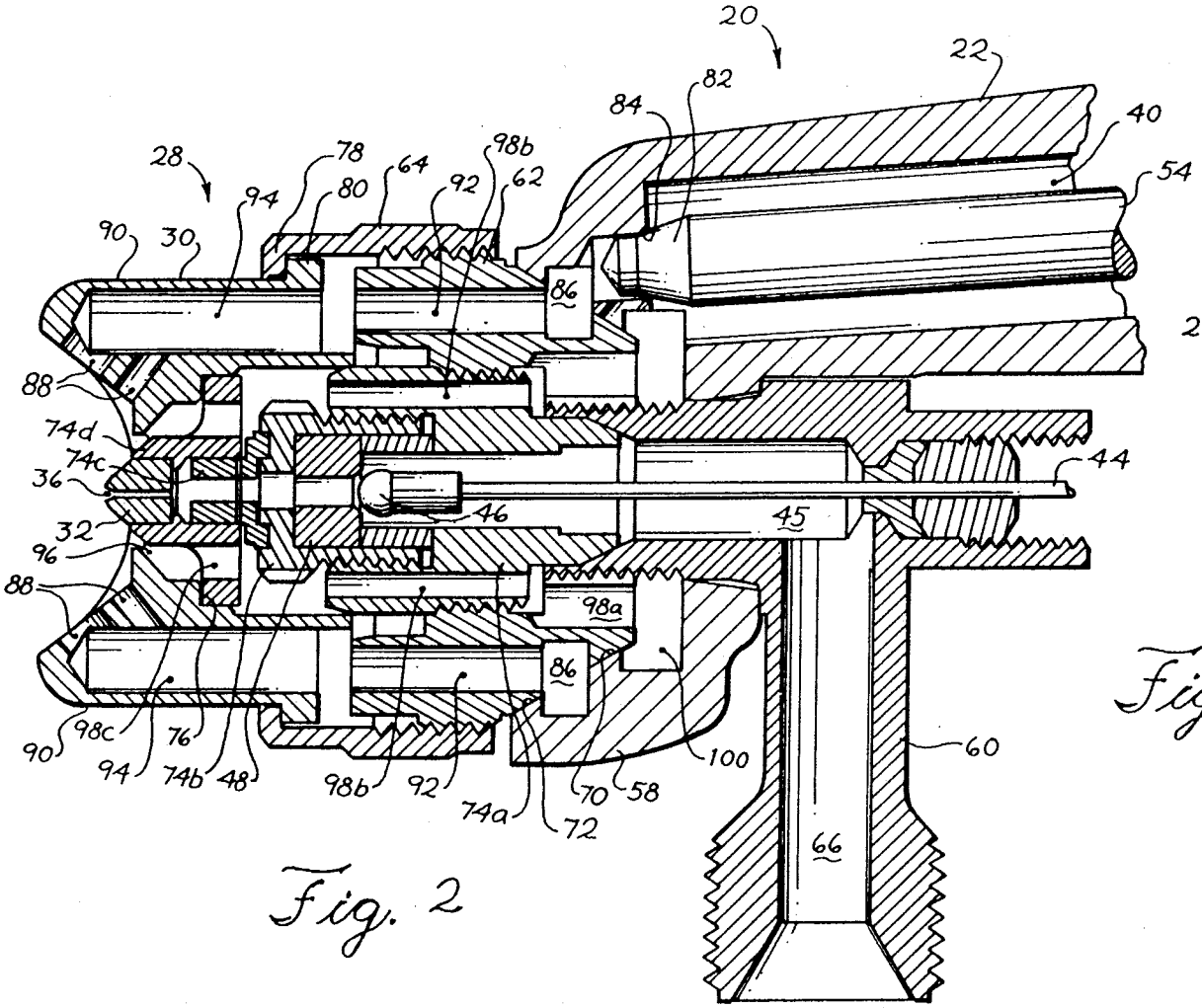
FIG. 2 is an enlarged, cross sectional side elevation view of the forward end of the spray gun in FIG. 1.

The drawings illustrate a hydraulically assisted high volume low pressure (HVLP) air spray gun assembly 20, which includes a spray gun body 22 having a handle 24 and an air inlet 26 at a lower end of the handle for connection with a source of compressed air at a relatively high pressure on the order of about 60 psi or more. At its forward end the gun has a spray head assembly 28 that includes an air nozzle 30 and an airless fluid tip 32. Liquid coating material is supplied to a fluid inlet 34 at a pressure in the range of about 25–1000 psi, depending upon the nature and viscosity of the material, and flows to a specially shaped elongate fluid outlet orifice 36 in the airless tip for being hydraulically emitted from the orifice in a flat fan-shaped pattern of coating liquid that is fully atomized in a flat fan-shaped spray by air emitted from the air nozzle. To deliver air from the air inlet to the air nozzle, an air passage 38 extends through the handle and is placed into communication with a gun body air passage 40 leading to the air nozzle, by opening an air valve means 42. A fluid valve stem 44 is connected to the air valve means and extends forwardly through a fluid passage 45 to a ball valve 46 at a forward end of the stem. The ball valve forms a fluid valve means with a seat in a valve member 48 located rearwardly of the airless tip 32.

To control spraying, the air valve means 42 is movable between closed and open positions to control a flow of pressurized air through the body passage 40 to the air nozzle 30 and the fluid valve stem 44 is movable between closed and open positions to move the ball valve 46 against and off of its seat to control a flow of coating material to and through the airless tip elongate orifice 36. For the purpose, a manually manipulatable trigger 50 is operatively connected to both the air valve means and the fluid valve stem and is pivotally connected to the gun body 22. The trigger is movable between a gun off position away from the handle 24, where the air valve means and the fluid valve means are closed, to a gun on position toward the handle, where the air valve means and fluid valve means are moved to their open positions to generate a fan-shaped spray of atomized coating material. An air control knob 52 is connected to a side port air valve stem 54 that extends through the gun body air passage and adjustment of the knob determines the flow rate of side port air emitted from the air nozzle 30 and impinged in air jets against opposite sides of the spray when the gun is triggered on. A fluid valve stem adjustment means is indicated generally at 56 and controls the volume flow rate of coating material from the fluid orifice 36 when the gun is triggered on.

The spray head assembly 28 mounts on an annular downwardly depending extension 58 at a forward end of the gun body 22. The spray head assembly includes the air nozzle 30 and the airless tip 32, together with a fluid inlet fitting 60, a fluid nozzle retainer 62 and an air nozzle retainer 64. The fluid inlet fitting has a fluid passage 66 extending from the fluid inlet 34 to the fluid passage 45.

The fluid inlet fitting 60 is generally L-shaped and a passage through the annular gun body extension 58 has a relatively small diameter at its rearward end and increases in diameter toward its forward end where it defines two tapered annular shoulders 70 and 72. The upper leg of the fluid inlet fitting is externally threaded at its forward end and extends through the annular extension passage into threaded connection with internal threads in the fluid nozzle retainer 62 to mount the fluid inlet fitting and retainer on the forward end of the gun body. When the fluid inlet fitting and retainer are threaded tightly together, a pair of tapered annular shoulders on the retainer abut and seal with the tapered shoulders 70 and 72.

A fluid nozzle sleeve 74*a* is threaded into the fluid nozzle retainer 62 until an outer annular tapered shoulder at its rearward end moves against and seals with an inner annular tapered shoulder at the forward end of the fluid inlet fitting 60. Passages through the fluid inlet fitting, the fluid nozzle sleeve 74*a*, the valve member 48, a valve member retainer 74*b*, a submerged jet member 74*c*, an airless tip holder 74*d* and the airless tip 32 provide a flow path for liquid coating material from the fluid inlet 34 to and through the fluid outlet orifice 36 upon retraction of the ball valve 46 from its seat on the valve member 48.

To complete the spray head assembly 28, the air nozzle 30 is placed over the forward end of the airless tip holder 74*d* to extend an outer end of the airless tip 32 through a passage formed centrally through a front wall of the air nozzle and to abut an annular shoulder 76 on the air nozzle against an annular shoulder on the airless tip holder. The air nozzle retainer 64 is then placed around the air nozzle and threaded onto the fluid nozzle retainer 62 so that a radially inwardly extending annular flange 78 on the air nozzle retainer engages a radially outwardly extending annular flange 80 on the air nozzle to move the air nozzle tightly against the airless tip holder.

To provide air to the spray head assembly 28, the gun body passage 40 receives high pressure low volume air from the handle passage 38 upon opening of the air valve means 42. The side port air valve stem 54 extends through the body passage and has a forward tapered end 82 that is moved against and away from a side port air valve seat 84 at the front end of the body passage in accordance with the setting of the side port air control knob 52. When the air valve stem is retracted from its seat, it opens communication between the body passage and an annular chamber 86 defined between the body extension 58 and the fluid nozzle retainer 62. The annular chamber communicates with side port air orifices 88 in diametrically opposed ears 90 of the air nozzle 30, through passages 92 in the fluid nozzle retainer 62 and passages 94 in the air nozzle 30. An annular atomizing air orifice 96 is defined around the forward end of the airless tip holder 74*d* by the circumference of the central passage through the front face of the air nozzle. To supply air to the atomizing air orifice 96, pluralities of passages 98*a–c* extend respectively through the fluid nozzle retainer 62, the fluid nozzle sleeve 74*a* and the airless tip holder 74*d* to provide an air flow path to the atomizing air orifice from an annular chamber 100 in communication with the gun body passage 40. Triggering the gun on opens the air valve means 42 and causes air to be emitted to fully atomize in a flat fan-shaped spray liquid coating material that is emitted in a flat fan-shaped pattern from the airless tip elongate fluid outlet orifice 36.

To control dispensing of coating material, the fluid valve stem 44 extends forwardly through the fluid inlet fitting 60 to its ball valve 46 at the seat of the valve member 48. Operation of the trigger 50 to turn the gun on retracts the stem and moves the ball valve from its seat to open a path for a flow of coating liquid to the orifice 36 for emission in a flat fan-shaped pattern of coating liquid. Because of the relatively low pressure of the coating liquid, as emitted from the fluid orifice the fan-shaped spray is not fully hydraulically atomized. However, the air emitted from the air nozzle 30 fully pneumatically atomizes the coating liquid into a flat fan-shaped spray.

To the extent described, the spray gun is similar to the one described by Culbertson et al. U.S. Pat. No. 4,537,357, issued Aug. 27, 1985 to the assignee of the present invention, the teachings of which are incorporated herein by reference. A difference, however, resides in the cross-sectional areas of the air flow passages and air outlet orifices. As compared with the spray gun of said Culbertson et al. patent, the present spray gun is an HVLP spray gun and its air passages and air orifices have relatively large cross sectional flow areas to accommodate a high volume flow of air at a low pressure.

Unlike most HVLP spray guns that require a separate turbine for supply of air at a relatively high volume and low pressure, the one of the invention is adapted to receive air at a high pressure and a low volume, e.g., from a compressed air supply at pressures on the order of about 60 psi and more. The gun may therefore be incorporated into existing spraying systems where a factory air supply already exists, without need to purchase and install a separate turbine.

The spray gun 20 is configured so that with about 60 psi of air at its inlet 26, when the gun is triggered on a high volume flow of air is delivered to the spray head assembly 28 at a low pressure that does not exceed a selected maximum value at the spray head, which advantageously is no greater than about 10 psi. For lower air inlet pressures the air at the spray head will be at a lower pressure, but because of the high air flow rate, coating material will be properly and fully atomized by air emitted from the atomizing air orifice 96. The air control knob 52 is adjustable to control the volume flow rate of air to the side port orifices 88. To prevent the pressure of air at the spray head from exceeding the selected maximum value as the flow rate of air to the side port orifices is changed, means are provided to vary the volume flow rate of air to the spray head in response to and in accordance with changes in the flow rate of air to the side port orifices.

The particular structure of the hydraulically assisted HVLP spray gun 20 that accommodates conversion of high pressure low volume air at the inlet 26 to high volume low pressure air at the spray head assembly 28, includes a guide bushing 102 in the gun body air passage 40, through which the air valve stem 54 extends. The air valve stem is longitudinally movable within the bushing by the air control knob 52 and a plurality of passages 104 extend longitudinally through the bushing. The bushing divides the body air passage into a portion 106 upstream from and a portion 108 downstream from the bushing. When the gun is triggered on to open the air valve means 42, high pressure air flows from the handle passage 38 into the passage portion 106 and then through the bushing passages 104 to the passage portion 108.

A restriction to the flow of air from the inlet 26 to the spray head assembly 28 is downstream from the bushing 102 and comprises a variable flow area restriction that may be a venturi 110 through which the air valve stem 54 extends. The venturi has a tapered upstream passage portion 112 and a tapered downstream passage portion 114. A shoulder 116 on the air valve stem defines a juncture between a forward portion 118 of the stem that has a first diameter and a rearward portion 120 that has a second and greater diameter. In a contemplated embodiment, the diameter of the forward portion 118 is 0.250", the diameter of the rearward portion 120 is 0.264" and the minimum necked down diameter of the passage through the venturi, between the passage portions 112 and 114, is 0.278 inch. When the tapered end 82 of the air valve stem is fully retracted from its seat 84 to provide a maximum volume flow rate of air to the side port orifices 88, the shoulder 116 is moved upstream from or rearwardly of, and the forward reduced diameter portion 118 of the stem extends through, the minimum diameter necked down portion of the venturi passage, so that the air flow area of and the volume flow rate of air through the venturi are at a maximum. When the tapered forward end of the stem is moved toward and against its seat to reduce and then terminate the flow of air to the side port orifices, the shoulder 116 and the increased diameter rearward portion 120 of the stem are moved forwardly into the minimum diameter necked down portion of the venturi passage, under which condition the air flow area of and the volume flow rate of air through the venturi are at a minimum. In the process of moving the tapered end of the air valve stem from its most retracted position to against its seat, as the shoulder 116 is moved forwardly through the upstream venturi passage portion 112, the air flow area through the venturi progressively decreases. The valve stem and venturi therefore define a variable flow area restriction and air entering the upstream end of the venturi at a low volume and high pressure exits the downstream end of the venturi at a high volume and low pressure.

With about 60 psi of air at the gun inlet 26 and the air valve 54 fully retracted to maximize the volume flow rate of air to the side port orifices 88, the passage through the restriction 110 has a maximum air flow area for delivery of a maximum volume flow rate of low pressure air to the spray head assembly 28. The air delivered to the spray head assembly has a high volume flow rate of at least 5 CFM and preferably at least 10–15 CFM or more, and a low pressure that does not exceed 15 psi and advantageously is no greater than about 10 psi. The liquid coating material emitted from the elongate fluid orifice 36 in the airless tip 32, while not supplied to the airless tip at a pressure sufficient for it to be fully hydraulically atomized, is fully atomized by the air emitted from the spray head atomizing air orifice 96.

If the air valve stem 54 were of uniform diameter, upon adjusting it to reduce the air flow to the side port orifices 88, the air flow area through the restrictor 110 would not be simultaneously reduced and, as the air exit area from the spray head is reduced, there could be an increase in the pressure of air at the spray head to more than the selected maximum pressure. However, because the air valve stem has the shoulder 116 and the increased diameter portion 120, as the stem is moved forwardly to reduce the flow rate of air to the side port orifices, the air flow area through the restriction is progressively reduced to decrease the volume flow rate of air supplied to the spray head and prevent an increase in the pressure of air at the spray head to more than the selected maximum pressure.

The invention therefore provides a novel hydraulically assisted HVLP air spray gun. The pressure at which coating liquid is delivered to the airless tip is sufficient to cause the coating to be hydraulically emitted in a flat fan-shaped pattern, but is not sufficient to cause the coating to be fully hydraulically atomized. Instead, high volume low pressure air is relied upon to pneumatically fully atomize the coating into a flat fan-shaped spray. However, because the coating is initially hydraulically emitted in a flat fan-shaped pattern, less pneumatic energy is required to break up the coating into a flat fan-shaped spray of highly atomized coating particles than would otherwise be required if, as conventional, the coating were hydraulically emitted in a cylindrical stream. Consequently, as compared with a conventional HVLP air spray gun, improved atomization is obtained with a given pressure and volume flow rate of air at the spray head of the gun.

While one embodiment of the invention has been described in detail, various modifications and other embodiments thereof may be devised by one skilled in the art without departing from the spirit and scope of the invention, as defined in the appended claims.

What is claimed is:

1. A method of performing high volume low pressure air spraying of liquid coating material, comprising the steps of delivering liquid coating material to a spray head; emitting the coating material delivered to the spray head from an elongate fluid orifice in the spray head in a flat fan-shaped pattern; supplying air to the spray head at a flow rate in excess of 10 CFM at the spray head and at a pressure of less than 15 psi at the spray head; and emitting the air supplied to the spray head from an atomizing air orifice in the spray head, that encircles the elongate fluid orifice, to break up the flat fan-shaped pattern of coating material into a flat fan-shaped atomized spray.

2. A method as in claim 1, wherein said supplying step supplies air to the spray head at a pressure of 10 psi or less at the spray head.

3. A method as in claim 1, wherein the elongate orifice is in an airless tip and said delivering step delivers coating material to the spray head at a pressure less than sufficient to hydraulically fully atomize the coating material upon its emission from the elongate orifice.

4. A method as in claim 1, further including the step of emitting air delivered to the spray head from opposed side port air orifices to impinge jets of air against opposite sides of the spray.

5. A method of performing high volume low pressure air spraying of liquid coating material, comprising the steps of delivering liquid coating material to a spray head; emitting the coating material delivered to the spray head from an elongate fluid orifice in the spray head in a flat fan-shaped pattern; supplying air to the spray head at a flow rate in excess of 10 CFM at the spray head and at a pressure of no more than 15 psi at the spray head; emitting air delivered to the spray head from an atomizing air orifice in the spray head, that encircles the elongate fluid orifice, to break up the flat fan-shaped pattern of coating material into a flat fan-shaped atomized spray and from opposed side port air orifices to impinge jets of air against opposite sides of the spray; adjusting the volume flow rate of air emitted from the side port air orifices; and, in response to and concurrently with performance of said adjusting step, adjustably controlling the volume flow rate of air supplied to the spray head to prevent the pressure of air at the spray head from exceeding a selected maximum pressure as a result of changes in the volume flow rate of air emitted from side port air orifices.

6. A method as in claim 5, wherein said adjustably controlling step decreases and increases the volume flow rate of air supplied to the spray head by amounts in accordance with respective decreases and increases in the volume flow rate of air emitted from the side port air orifices.

7. A method as in claim 5, wherein said adjusting and said adjustably controlling steps are performed using a single valve member.

8. A method as in claim 5, wherein said supplying step supplies air to the spray head at a pressure of 10 psi or less at the spray head.

9. A method as in claim 5, wherein the elongate orifice is in an airless tip and said delivering step delivers coating material to the spray head at a pressure less than sufficient to hydraulically fully atomize the coating material upon its emission from the elongate orifice.

10. A hydraulically assisted high volume low pressure air spray coating apparatus, said apparatus comprising a spray head having an elongate fluid orifice and an atomizing air orifice encircling said elongate fluid orifice; means for delivering liquid coating material to said spray head for emission from said elongate fluid orifice in a flat fan-shaped pattern; and means for supplying air to said spray head at a flow rate in excess of 10 CFM at said spray head and at a pressure of less than 15 psi at said spray head for emission from said atomizing air orifice to break up the flat fan-shaped pattern of coating material into a flat fan-shaped atomized spray.

11. Apparatus as in claim 10, wherein said supplying means supplies air to said spray head at a pressure of 10 psi or less at said spray head.

12. Apparatus as in claim 10, wherein said elongate orifice is in an airless tip of said spray head and said delivering means delivers coating material to said spray head at a pressure less than sufficient to hydraulically fully atomize the coating material upon its emission from said elongate fluid orifice.

13. A hydraulically assisted high volume low pressure air spray coating apparatus, said apparatus comprising a spray head having an elongate fluid orifice, an atomizing air orifice encircling said elongate fluid orifice, and opposed side port air orifices; means for delivering liquid coating material to said spray head for emission from said elongate fluid orifice in a flat fan-shaped pattern; means for supplying air to said spray head at a flow rate in excess of 10 CFM at said spray head and at a pressure of no more than 15 psi at said spray head for emission from said atomizing air orifice break up the flat fan-shaped pattern of coating material into a flat fan-shaped atomized spray and from said opposed side port air orifices to impinge jets of air against opposite sides of the spray; means for adjusting the volume flow rate of air emitted from said side port air orifices; and means, responsive to operation of said adjusting means, for concurrently adjustably controlling the volume flow rate of air supplied to said spray head to prevent the pressure of air at said spray head from exceeding a selected maximum pressure as a result of changes in the volume flow rate of air emitted from said side port air orifices.

14. Apparatus as in claim 13, wherein said adjustably controlling means decreases and increases the volume flow rate of air supplied to said spray head by amounts in accordance with respective decreases and increases in the volume flow rate of air delivered to said side port air orifices.

15. Apparatus as in claim 13, including valve means common to each of said adjusting means and said adjustably controlling means for simultaneously changing the volume flow rates of air emitted from said side port air orifices and supplied to said spray head.

16. Apparatus as in claim 13, wherein said supplying means supplies air to said spray head at a pressure of 10 psi or less at said spray head.

17. Apparatus as in claim 13, wherein said spray head includes an airless tip, said elongate orifice is in said airless tip and said delivering means delivers coating material to said spray head at a pressure less than sufficient to hydraulically fully atomize the coating material upon its emission from said elongate orifice.

* * * * *